US008587483B2

(12) United States Patent
Yoo et al.

(10) Patent No.: US 8,587,483 B2
(45) Date of Patent: Nov. 19, 2013

(54) PATCH ANTENNA

(75) Inventors: Tae-Hwan Yoo, Seoul (KR); Byoung-Nam Kim, Kyeonggi-Do (KR)

(73) Assignee: Ace Technologies Corporation, Incheon (KR)

( * ) Notice: Subject to any disclaimer, the term of this patent is extended or adjusted under 35 U.S.C. 154(b) by 195 days.

(21) Appl. No.: 13/198,243

(22) Filed: Aug. 4, 2011

(65) Prior Publication Data

US 2012/0038529 A1 Feb. 16, 2012

(30) Foreign Application Priority Data

Aug. 12, 2010 (KR) ..... 10-2010-0077729

(51) Int. Cl.
*H01Q 1/38* (2006.01)

(52) U.S. Cl.
USPC ..... 343/700 MS; 343/767

(58) Field of Classification Search
USPC ..... 343/700, 767, 846
See application file for complete search history.

(56) References Cited

U.S. PATENT DOCUMENTS

| | | | | |
|---|---|---|---|---|
| 5,187,490 | A * | 2/1993 | Ohta et al. | 343/770 |
| 5,293,171 | A * | 3/1994 | Cherrette | 343/700 MS |
| 5,309,164 | A * | 5/1994 | Dienes et al. | 343/700 MS |
| 5,444,452 | A * | 8/1995 | Itoh et al. | 343/700 MS |
| 5,497,164 | A * | 3/1996 | Croq | 343/700 MS |
| 5,646,634 | A * | 7/1997 | Bokhari et al. | 343/700 MS |
| 8,228,254 | B2 * | 7/2012 | Foltz et al. | 343/795 |

* cited by examiner

*Primary Examiner* — Tho G Phan
(74) *Attorney, Agent, or Firm* — Edwards Wildman Palmer LLP

(57) ABSTRACT

A patch antenna is disclosed. The disclosed patch antenna may include: a first radiator configured to generate a circular polarized wave; a first dielectric substrate equipped under the first radiator; a second radiator, placed under the first radiator at a designated distance from the first radiator, and configured to generate a linear polarized wave; a second dielectric substrate equipped under the second radiator; and a reflecting plate equipped under the second radiator at a designated distance from the second radiator; where the first dielectric substrate, the second radiator, the second dielectric substrate, and the reflecting plate are connected through at least one via. A patch antenna according to the present invention has the advantages of being able to generate linear polarized waves and circular polarized waves simultaneously, and of having a small size while still having a high design frequency band.

9 Claims, 6 Drawing Sheets

PATCH ANTENNA

CROSS-REFERENCE TO RELATED APPLICATIONS

This application claims under 35 U.S.C. §119(a) the benefit of Korean Application No. 10-2010-0073704 filed Jul. 29, 2010, the entire contents of which are incorporated herein by reference.

TECHNICAL FIELD

The present invention relates to a patch antenna, more particularly to a patch antenna configured to generate both linearly polarized waves and circular polarized waves simultaneously.

BACKGROUND ART

With advances in wireless communication technology, it has become possible to popularize information communication terminals such as mobile telephones, PDA's, GPS receivers, etc. In such information communication terminals, small-size, light-weight, thin and flat patch antennae are mainly used.

In general, the size of a patch antenna is proportionate to design frequency. Consequently, in order to produce a patch antenna that is able to generate polarized waves of the same frequency band and that is of a smaller size, a dielectric substrate having a high dielectric constant should be used.

However, using a dielectric having a high dielectric constant degrades the radiating characteristics of the antenna, resulting in lower profits and higher production costs, as well as lower production yield. Consequently, there is a limit to how far the size of an antenna may be reduced with the use of a dielectric having a high dielectric constant. Accordingly, there are on-going attempts through structural changes to produce patch antennae having a high design frequency band while having a small size.

At the same time, a patch antenna according to the related art makes right-handed circular polarized waves (RHCP) or left-handed circular polarized waves (LHCP) by changing the feeding position on the patch surface or the patch structure. Here, transmission and reception are achieved between patch antennae of the same rotational direction (RHCP or LHCP).

However, in areas such as inside a tunnel where the signal's line of sight (LOS) is not guaranteed, due to the fading phenomenon, linear polarized waves need to be received with the use of a patch antenna that generates circular polarized waves. Here, a wave loss of −3 dB occurs, creating a problem of not being able to receive signals efficiently.

The above information disclosed in the Background Art section is only for enhancement of understanding of the background of the invention and therefore it may contain information that does not form the prior art that is already known in this country to a person of ordinary skill in the art.

SUMMARY OF THE DISCLOSURE

To resolve the problem of the related art addressed above, an aspect of the invention provides a patch antenna that can generate linear polarized waves and circular polarized waves simultaneously.

Another purpose of the present invention is to provide a patch antenna having both a small size and a high design frequency band.

To achieve the objective above, an aspect of the invention provides a patch antenna that includes: a first radiator configured to generate a circular polarized wave; a first dielectric substrate equipped under the first radiator; a second radiator placed under the first radiator at a designated distance from the first radiator and configured to generate a linear polarized wave; a second dielectric substrate equipped under the second radiator; and a reflecting plate equipped under the second radiator at a designated distance from the second radiator, where the first dielectric substrate, the second radiator, the second dielectric substrate and the reflecting plate are connected through at least one via hole.

The first dielectric substrate and the second dielectric substrate may be FR4 substrates.

The first radiator may include an X-shaped slot.

The second radiator may have the shape of a band in which an interior space is formed corresponding to the shape of the first radiator.

The first dielectric substrate, the second radiator and the second dielectric substrate each may have at least one via hole, the reflecting plate may be connected to multiple electric conductor pins that are formed to enable insertion into the via hole, and the first dielectric substrate, the second radiator, the second dielectric substrate and the reflecting plate may be connected by the multiple electric conductor pins being inserted into the at least one via hole.

The first dielectric substrate, the second radiator and the second dielectric substrate each may have at least one via hole filled with electric conductor, and the first dielectric substrate, the second radiator, the second dielectric substrate and the reflecting plate may be connected by the at least one via hole filled with an electric conductor.

The first radiator, the first dielectric substrate, the second radiator, and the second dielectric substrate may be quadrilateral in shape, the first radiator may have an X-shaped slot formed diagonally, and the at least one via hole may be formed in any one pair of corner of two pairs of corners placed diagonally to each other on the first dielectric substrate, the second radiator, and the second dielectric substrate.

The rotational direction of the circular polarized wave generated by the first radiator may be determined by the position of the any one pair of corners.

The frequency band of the circular polarized wave generated by the first radiator may be determined by the number of via holes formed in the any one pair of corners.

The at least one via hole formed in the any one pair of corners may be formed symmetrically to each other with respect to an imaginary diagonal line connecting the pair of corners.

A patch antenna according to the present invention has the advantage of being able to generate linear polarized waves and circular polarized waves simultaneously.

Also, a patch antenna according to the present invention has the advantage of having a high design frequency band while being of a small size.

DETAILED DESCRIPTION OF THE DISCLOSURE

Figure 1:
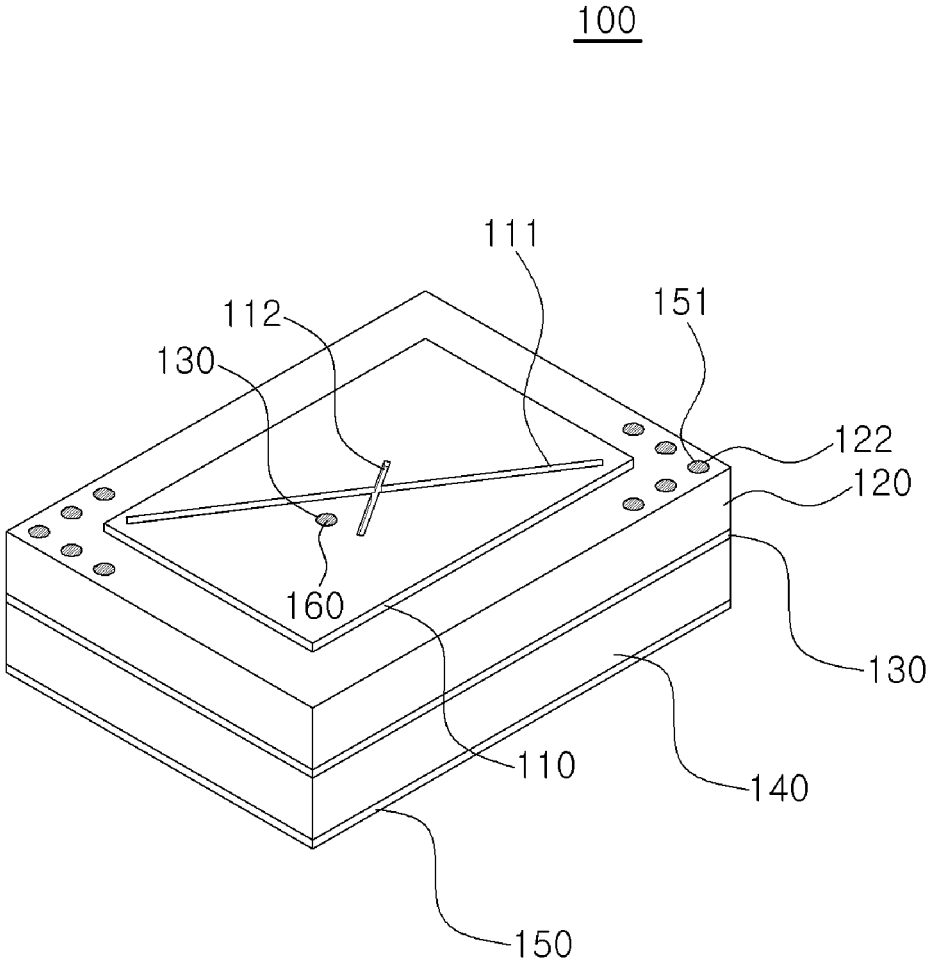
FIG. 1 is a drawing illustrating the perspective view of a patch antenna according to an embodiment of the present invention.

As the present invention may have various changes and modifications made to it and may have several embodiments, certain embodiments of the invention will be described below in more detail with reference to the accompanying drawings. However, the embodiments are for illustrative purposes only and do not limit the invention, which includes all changes, modifications and substitutions encompassed by the spirit and technical scope of the invention. Those components that are the same or are in correspondence are rendered the same reference numeral regardless of the figure number.

Hereinafter, embodiments of the present invention will be described in more detail with reference to the accompanying drawings.

Figure 2:
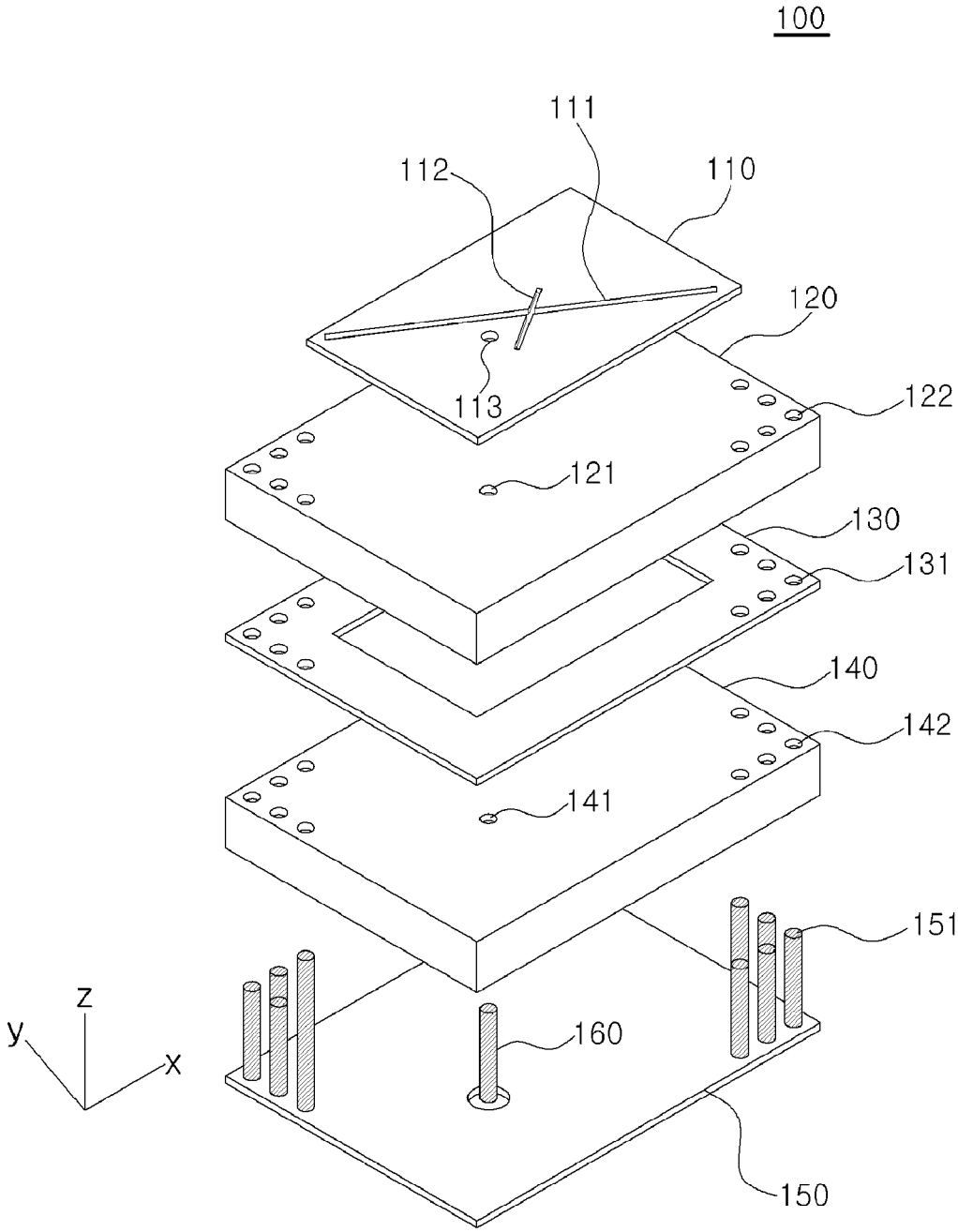
FIG. 2 is a drawing illustrating the exploded perspective view of a patch antenna according to an embodiment of the present invention.

FIG. 1 is a drawing illustrating the perspective view of a patch antenna according to an embodiment of the present invention and FIG. 2 is a drawing illustrating the exploded perspective view of a patch antenna according to an embodiment of the present invention.

Referring to FIG. 1 and FIG. 2, a patch antenna 100 according to an embodiment of the present invention may include a first radiator 110, a first dielectric substrate 120, a second dielectric substrate 140, a reflecting plate 150 and a feeding unit 160.

In FIG. 1 and FIG. 2, the first radiator 110, the first dielectric substrate 120, the second radiator 140, and the reflecting plate 150 are illustrated as being rectangular in shape, but this is only one embodiment of the present invention, and the first radiator 110, the first dielectric substrate 120, the second radiator 140, and the reflecting plate 150 may be not only rectangular but may be of various shapes, such as square.

Each component and its function will be described below with reference to FIG. 1 and FIG. 2.

The first radiator 110 is a radiator (patch surface) for generating circular polarized waves (CP), and generates circular polarized waves when it has a positive (+) pole and when it has a negative (−) pole having a cycle of 0.5λ.

Here, a circular polarized wave means a polarized wave whose vector locus—indicating size and direction of an electric field on a surface perpendicular to the propagating direction of an electric wave—draws a circle. In other words, if a horizontal polarized wave and a vertical polarized wave of the same size and of phases differing by 90° are merged, their combined electric field vector forms a circle, and a circular polarized wave is generated by this. A circular polarized wave can be a right-handed circular polarized wave, whose vector traces a circle clockwise, or a left-handed circular polarized wave, whose vector traces a circle counter-clockwise.

Also, the first radiator 110 has slots 111 and 112, forming an X. As an example, the X-shaped slots 111 and 112 may be formed diagonally in the first radiator 110.

As illustrated in FIG. 1 and FIG. 2, the length of each of the slots 111 and 112 forming an X may be different. As described below, this is for generating both right-handed circular polarized waves and left-handed circular polarized waves through the patch antenna 100. Such slots 111 and 112 forming an X have the functions of reducing patch surface to 0.3λ, and of expanding the frequency band in which the axial ratio—a variable of circular polarized wave performance—is formed.

Next, the first dielectric substrate 120 is equipped under the first radiator 110.

As described earlier, in order to produce a patch antenna of a small size, it is preferable to use a dielectric substrate having a high dielectric constant, but when using a dielectric having a high dielectric constant, problems may occur such as a decrease in radiating characteristics of the antenna and an increase in production cost. Hence, the patch antenna 100 according to an embodiment of the present invention includes a FR4 (flame retardant 4) substrate having an ordinary dielectric constant as the first dielectric substrate 120, and as described below, achieves an effect comparable to increasing the dielectric constant by connecting the reflecting plate 150 and the first dielectric substrate 120 through a via hole. At the same time, the FR4 substrate is laminated with glass epoxy, and its critical temperature is 120-130° C., which is somewhat affected by heat depending on the thickness.

Next, the second radiator 130, placed at a designated distance from the first radiator 110, is equipped under the first dielectric substrate 120.

The second radiator 130 is a radiator for generating linear polarized waves while at the same time being a patch surface for performing the role of a reflector for the first radiator 110, and generates linear polarized waves when it has a negative pole and when it has a positive pole having a cycle of 0.5λ. Here, a linear polarized wave means a polarized wave whose vector locus—indicating size and direction of the electric field on a surface perpendicular to the propagating direction of an electric wave—draws a vertical or a horizontal line.

According to a preferred embodiment of the present invention, the second radiator 130 may be in the form of a band with an interior space corresponding to the shape of the first radiator 110, as illustrated in FIG. 2.

Next, the second dielectric substrate 140 is equipped under the second radiator 130.

The second dielectric substrate 140, like the first dielectric substrate 120 described earlier, may also be a substrate made of FR4 material. Also, when using an FR4 substrate for the second dielectric substrate 140, it achieves an effect comparable to increasing the dielectric constant by connecting the reflecting plate 150 and the second dielectric substrate 140 through a via hole, as in the case with the first dielectric substrate 120. A detailed description will be provided below with regard to this.

Also, the reflecting plate 150 is equipped under the second dielectric substrate 140 at a designated distance from the second radiator 130.

The reflecting plate 150, coupled with the first radiator 110, generates circular polarized waves, while at the same time, being coupled with the second radiator 130, generates linear polarized waves. In other words, the first radiator 110 uses the second radiator 130 and the reflecting plate 150 as reflectors to generate circular polarized waves, and the second radiator 130 uses the reflecting plate 150 as a reflector to generate linear polarized waves.

Here, the reflecting plate 150 may be made of a metallic material (for example, aluminum) in order to evenly reflect signals inputted from the first radiator 110 and the second radiator 130.

The feeding unit 160 feeds signals to the first radiator 110. Here, the feeding unit 160 is inserted through the holes 113, 121 and 141 formed in the first radiator 110, the first dielectric substrate 120 and the second dielectric substrate 140, and can feed signals to the first radiator 110.

At the same time, since the size of a patch antenna is proportionate to the design frequency as described earlier, a dielectric substrate of a high dielectric constant should be used in order to produce a patch antenna having a smaller size while generating polarized wave of the same frequency band. However, when using a dielectric substrate of a high dielectric constant, there occurs the problem of a decrease in radiating characteristics and an increase in production cost.

Consequently, the patch antenna 100 according to an embodiment of the present invention resolves the problem with regard to radiating characteristics and production cost by using dielectric substrates 120 and 140 made of FR4 material having an ordinary dielectric constant, while at the same time achieving the effect of raising the dielectric constant by connecting the first dielectric substrate 120, the second radiator 130, the second dielectric substrate 140, and the reflecting plate 150 through at least one via hole.

That is to say, when connecting the first dielectric substrate 120, the second radiator, the second dielectric substrate 140 and the reflecting plate 150 through at least one via hole, there occurs the effect of relatively increasing the width of the reflecting plate 150 that acts as a reflector for the first radiator 110 and the second radiator 130, thereby achieving an effect identical or similar to the use of dielectric substrates 120 and 140 having a high dielectric constant. Due to the aforementioned structural features, the patch antenna 100 according to an embodiment of the present invention improves radiating efficiency, achieving the effect of guaranteeing stability of circular polarized wave characteristics.

Here, a connection through via holes is achieved by inserting one or more electric conductor pins 151 formed in (or connected to) the reflecting plate 150 through one or more via holes 122, 131 and 142 formed in the first dielectric substrate 120, the second radiator 130 and the second dielectric substrate 140.

That is to say, the first dielectric substrate 120, the second radiator 130, and the second dielectric substrate 140 each have at least one via hole 122, 131 and 142, the reflecting plate 150 is connected to at least one electric conductor pin 151 that are formed to be insertable through the via holes 122, 131 and 142, and the first dielectric substrate 120, the second radiator 130, the second dielectric substrate 140 and the reflecting plate 150 may be connected by at least one electric conductor pin 151 inserted through the at least one via hole 122, 131 and 142.

According to an embodiment of the present invention, the at least one via hole may be formed in any one of two pairs of diagonally facing corners on the first dielectric substrate 120, the second radiator 130, and the second dielectric substrate 140.

In other words, the at least one via hole 122, 131 and 142 may be formed in any one pair of corner of two pairs of corners placed diagonally to each other on the first dielectric substrate 120, the second radiator 130 and the second dielectric substrate 140 respectively, and the electric conductor pin 151 may be formed in the positions on the reflecting plate 150 corresponding to the positions of the at least one via hole 122, 131 and 142.

If the number of via holes is two or more, the two or more via holes may be formed symmetrically with respect to an imaginary line connecting the diagonally facing corners, as illustrated in FIG. 1 and FIG. 2.

According to an embodiment of the present invention, the rotational direction of a circular polarized wave generated by the first radiator 110 is determined by the position of the any one pair of corners where via holes are formed.

Figure 3:
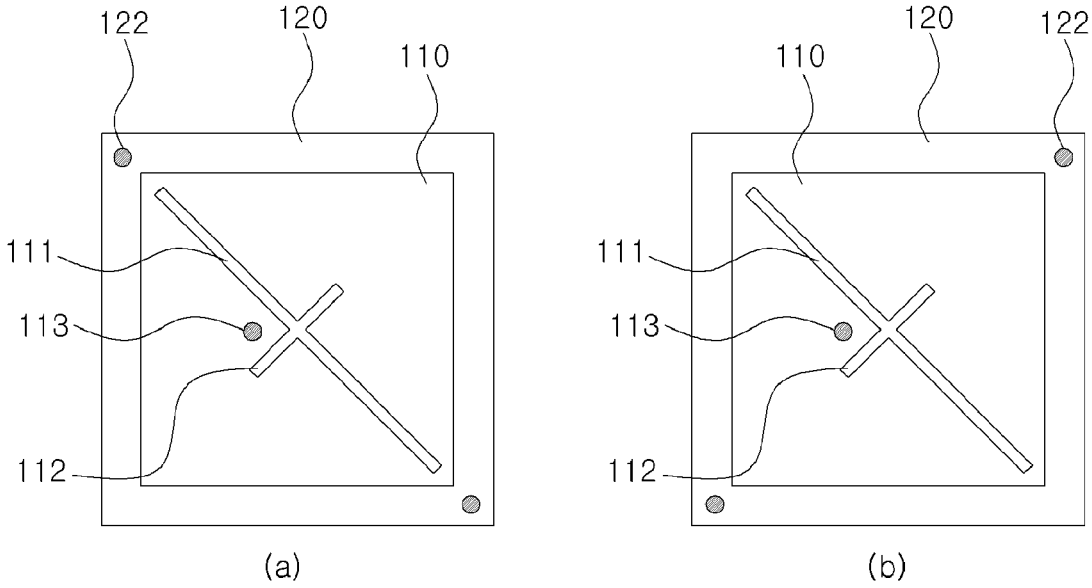
FIG. 3 is a drawing illustrating the directional change of a circular polarized wave according to the position of via holes formed in a patch antenna according to an embodiment of the present invention.

As an example, as illustrated in FIG. 3(*a*), if the at least one via hole is formed in one pair of diagonally facing corners in line with the longer slot 111 of the two slots 111 and 112 forming an X on the first radiator 110, the first radiator 110 can generate left-handed circular polarized waves. Conversely, as illustrated in FIG. 3(*b*), if the at least one via hole is formed in one pair of diagonally facing corners in line with the shorter slot 112, the first radiator 110 can generate right-handed circular polarized waves.

Figure 4:
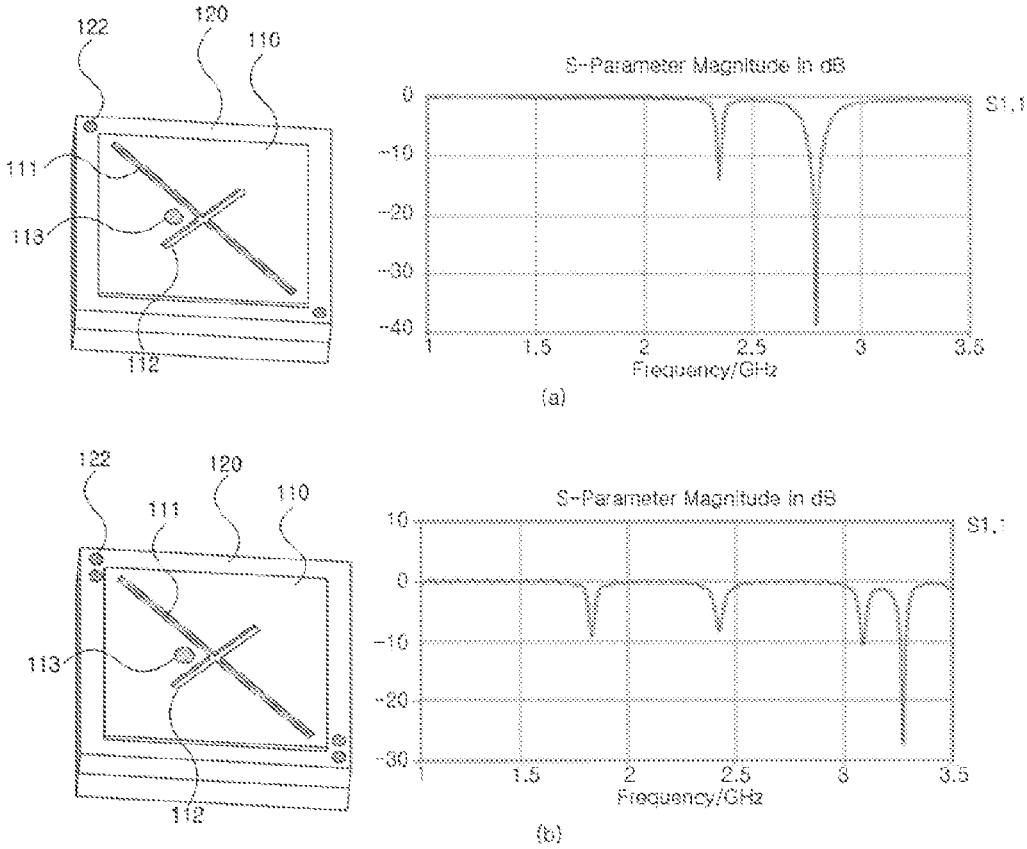
FIG. 4 and FIG. 5 are a drawing illustrating the change in frequency characteristics according to the number of via holes formed in a patch antenna according to an embodiment of the present invention.
Figure 5:
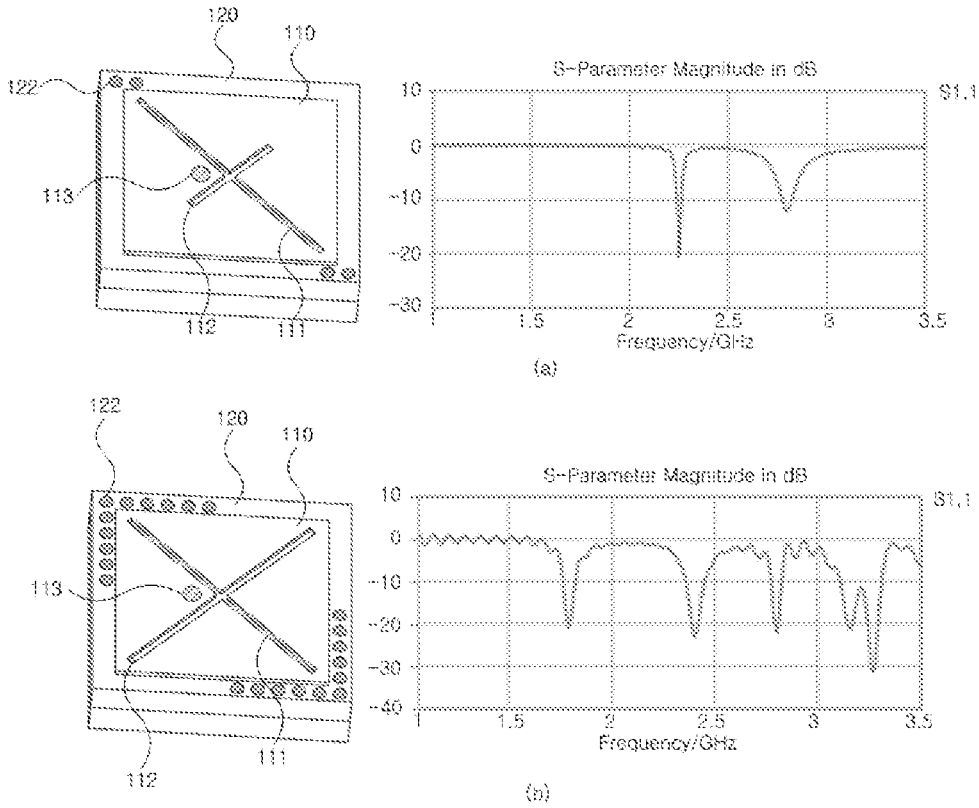

Also, according to an embodiment of the present invention, the frequency band of circular polarized waves generated by the first radiator 110 can be determined by the number of via holes formed in the any one pair of diagonally facing corners. That is to say, the frequency band of circular polarized waves can be adjusted according to the number of via holes, as illustrated in FIG. 4 and FIG. 5.

In this manner, the patch antenna according to an embodiment of the present invention 100 can generate linear polarized waves and circular polarized waves simultaneously by using the first radiator 110 and the second radiator 130, and can be small in size while still being able to transmit or receive signals of a high frequency band by means of connection of the radiators 110 and 130 with the reflecting plate 150 through via holes.

Figure 6:
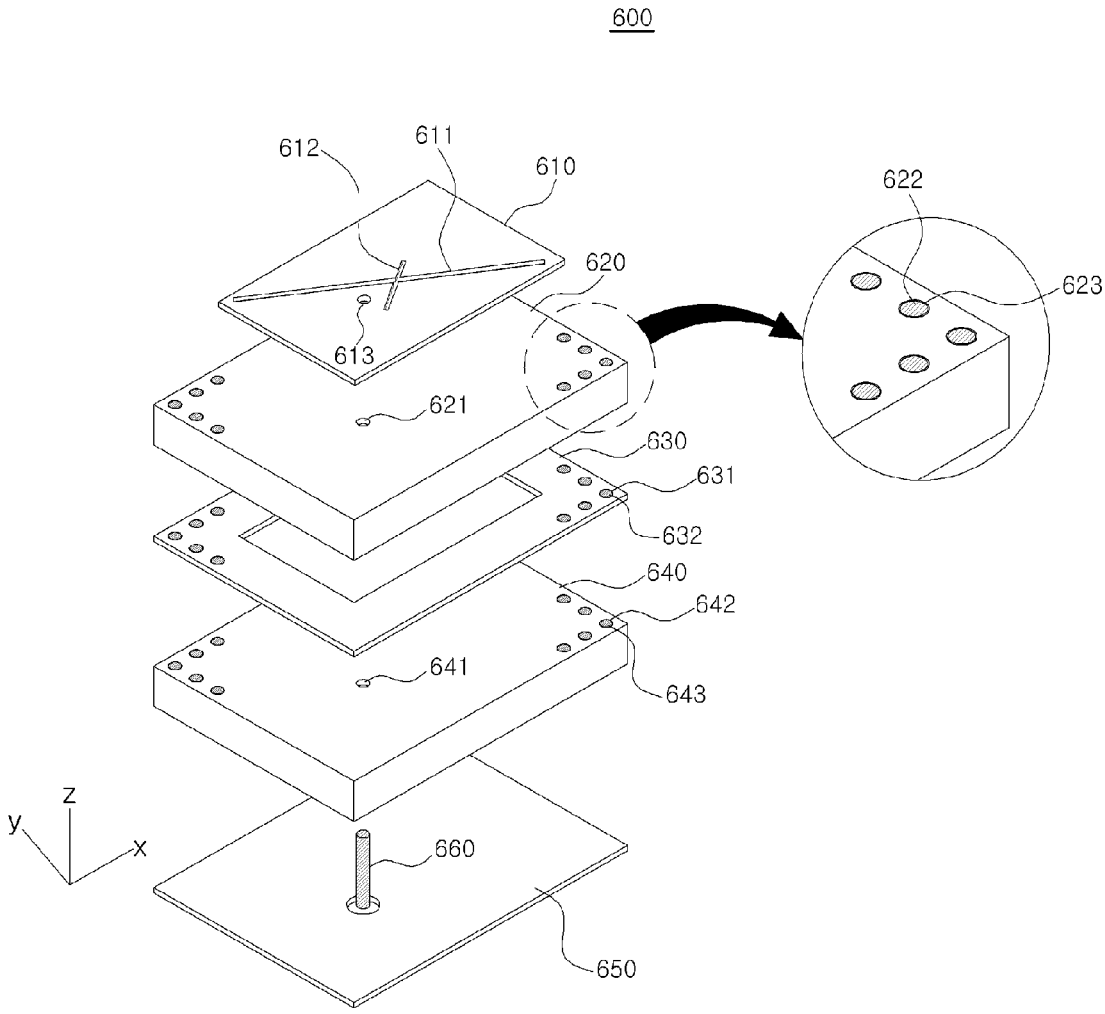
FIG. 6 is a drawing illustrating the perspective view of a patch antenna according to another embodiment of the present invention.

FIG. 6 is a drawing illustrating the perspective view of a patch antenna according to another embodiment of the present invention.

Referring to FIG. 6, a patch antenna according to another embodiment of the present invention may include a first radiator 610, a first dielectric substrate 620, a second radiator 630, a second dielectric substrate 640, a reflecting plate 650, and a feeding unit 660.

The patch antenna illustrated in FIG. 6 has the same structure as the patch antenna 100 described in FIG. 1 and FIG. 2, with the exception of the connecting structure through via holes. Consequently, description will be given below only of a connecting structure through via holes of the first dielectric substrate 620, the second radiator 630, the second dielectric substrate 640, and the reflecting plate 650.

As illustrated in FIG. 6, the patch antenna 600 according to another embodiment of the present invention does not use electric conductor pins, but rather, uses via holes 622, 631 and 642 formed in the first dielectric substrate 620, the second radiator 630, and the second dielectric substrate 640, where the via holes 622, 631 and 642 are filled and coupled with electric conductors 623, 632 and 643. Accordingly, the first dielectric substrate 620, the second radiator 630, the second dielectric substrate 640 and the reflecting plate 650 are connected through via holes.

While the spirit of the invention has been described in detail with reference to particular embodiments and drawings, the embodiments are for illustrative purposes only and do not limit the invention. It is to be appreciated that those skilled in the art can change or modify the embodiments without departing from the scope and spirit of the invention. Therefore, the scope of the invention is not to be defined by the foregoing descriptions, but by the scope of claims appended below and all variations coming within the meaning and range of equivalency of the claims.

The invention claimed is:

1. A patch antenna comprising:

a first radiator configured to generate a circular polarized wave;

a first dielectric substrate equipped under the first radiator;

a second radiator placed under the first radiator at a designated distance from the first radiator and configured to generate a linear polarized wave;

a second dielectric substrate equipped under the second radiator; and a reflecting plate equipped under the second radiator at a designated distance from the second radiator, wherein the first dielectric substrate, the second radiator, the second dielectric substrate and the reflecting plate are connected through at least one via hole, wherein the second radiator has a shape of a band with an interior space formed therein corresponding to a shape of the first radiator.

2. The patch antenna according to claim 1, wherein the first dielectric substrate and the second dielectric substrate are FR4 substrates.

3. The patch antenna according to claim 1, wherein the first radiator includes an X-shaped slot.

4. The patch antenna according to claim 1, wherein the reflecting plate is connected to multiple electric conductor pins that are formed to enable insertion into the via hole, and the first dielectric substrate, the second radiator, the second dielectric substrate and the reflecting plate are connected by the multiple electric conductor pins being inserted into the at least one via hole.

5. The patch antenna according to claim 1, wherein the at least one via hole is filled with an electric conductor.

6. The patch antenna according to claim 1, wherein the first radiator, the first dielectric substrate, the second radiator, and the second dielectric substrate are quadrilateral in shape, the first radiator has an X-shaped slot formed diagonally, and the at least one via hole is formed in any one pair of corners of two pairs of corners placed diagonally to each other on the first dielectric substrate, the second radiator, and the second dielectric substrate.

7. The patch antenna according to claim 6, wherein a rotational direction of the circular polarized wave generated by the first radiator is determined by a position of the any one pair of corners.

8. The patch antenna according to claim 6, wherein a frequency band of the circular polarized wave generated by the first radiator is determined by the number of via holes formed in the any one pair of corners.

9. The patch antenna according to claim 6, wherein the at least one via hole formed in the any one pair of corners are formed symmetrically to each other with respect to an imaginary diagonal line connecting the pair of corners.

* * * * *